United States Patent [19]

Nowak et al.

[11] Patent Number: 4,632,224

[45] Date of Patent: Dec. 30, 1986

[54] MULTICOMPARTMENT ELEVATOR CALL ASSIGNING

[75] Inventors: Frederick H. Nowak, Southington; John C. Luce, Milford, both of Conn.

[73] Assignee: Otis Elevator Company, Farmington, Conn.

[21] Appl. No.: 722,953

[22] Filed: Apr. 12, 1985

[51] Int. Cl.[4] ..... B66B 1/18

[52] U.S. Cl. ..... 187/29 R

[58] Field of Search ..... 187/29

[56] References Cited

U.S. PATENT DOCUMENTS 3,625,311 12/1971 Nowak et al. ..... 187/29 R 4,582,173 4/1986 Schröder ..... 187/29 R

*Primary Examiner*—William M. Shoop, Jr.

*Assistant Examiner*—W. E. Duncanson, Jr.

[57] ABSTRACT

In an elevator having a group of double-deck cars, a hall call is assigned to one of the decks according to a priority scheme that takes into account the service capability of each car and its decks in a way that favors assignment of the call to the lagging deck of the car most capable of answering the call.

4 Claims, 2 Drawing Figures

MULTICOMPARTMENT ELEVATOR CALL ASSIGNING

DESCRIPTION

1. Technical Field

This invention pertains to call assignment in a group of elevators having double-deck, sometimes called multicompartment, cars.

2. Background Art

Double-deck elevators are a special type, usually used in tall, narrow buildings, mainly because they minimize car space by distributing passenger load vertically into stacked compartments, instead of separate cars.

Usually, service is restricted from two lobby landings, upper and lower, to alternate floors. Passengers destined for odd floors must use one compartment; those destined for even floors must use the other compartment. Thus, passengers are channeled to the correct compartment or deck at the lobbies, the consequence of which is that there are fewer stops during up-peak conditions as compared to a single car system. In a fully restricted system, each deck can only service adjacent hall calls. At an early point in the evolution of double-deck systems, totally unrestricted operation was employed, but this did not provide efficient up-peak operation.

Ideally, a system should blend restricted and unrestricted operation. It should provide floor-to-floor runs with either deck and restricted operation from the lobbies, and U.S. Pat. No. 3,625,311 by Nowak et al, which, like this application, is assigned to Otis Elevator Company, describes a system like that. Unrestricted operation between intermediate landings means that passengers do not have to walk between adjacent floors, which they must do if operation is restricted.

DISCLOSURE OF INVENTION

The present invention is directed to selecting the best deck, among all the decks, for answering a hall call at an intermediate landing under unrestricted operating conditions.

According to the invention, the position, loading and call status of each deck are used to assign the deck bonus and penalty points which manifest the deck's capability to service the hall call. Because each car has two decks, certain bonuses and penalties associated with the car—rather than the decks, per se—are assigned to each deck. With respect to the two decks on a car, the deck furthest from the call, the lagging deck, is favored. But, as between cars, the car with the most bonuses and least penalties is favored. The bonus and penalty points are weighted to reflect their relative importance. The assignment scheme is biased towards assignments of two floor runs for each deck to decrease the number of intermediate stops for each car and overall system response time.

BEST MODE FOR CARRYING OUT THE INVENTION

The invention is described herein in a system employing one or more digital computers, which may be of any known type. The application resides in the use of the computer to carry out an overall system operation according to the invention to achieve a special type of elevator operation. Hence, computer peripherals, such as input/output ports (I/O), are shown simply for establishing the general environment for carrying out the invention. Moreover, it does not matter whether the computer is analog or digital, or a microcomputer, or even one that is hardwired or dedicated, although digital is considered the least expensive. Numerous treatises and patents are available for instruction on utilization of a computer of any known type for carrying out the invention.

Figure 1:
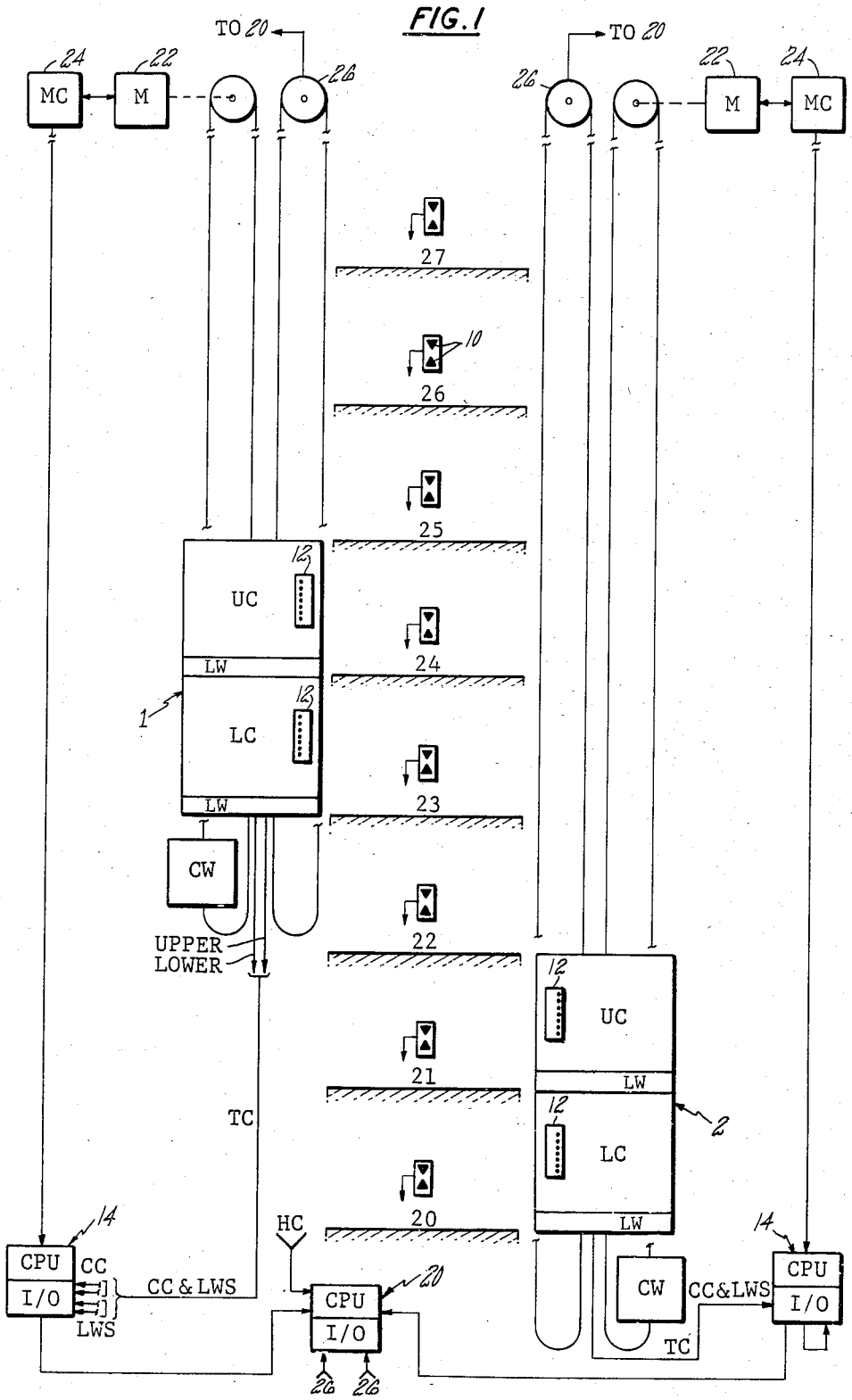
FIG. 1 is a block diagram of an elevator that has two double-deck cars.

In FIG. 1, two elevator cars 1 and 2 serve a plurality of landings in a building (arbitrarily numbered 20–27). A hall call button 10, for "up" and "down", is located on each landing for entering a hall call, which is then assigned to one of the cars in an assignment scheme according to the present invention, which scheme will be described more throughout this discussion.

Each car 1, 2 has an upper compartment UC and a lower compartment LC. Each compartment contains a car operating panel 12 that contains car call buttons, by which passengers enter a service request to one of the floors in the building. The calls are transmitted over a traveling cable TC to a car controller 14 that contains a computer CPU and its associated input/output I/O ports. Car calls CC are thus supplied to the car controller, which directs the CC's to a group controller 20 that has a CPU and associated I/O ports. The group controller also receives the hall calls HC from the hall buttons 10.

Each car is propelled by a motor 22 that is connected to a sheave, around which the car drive ropes are wound. The motor 22 is controlled by a motor control 24, which receives stop and start signals from the car controller 14.

A counterweight CW is attached to the car. A position transducer 26 provides signals to the car controller. Those signals manifest the car position and are used by the motor control in regulating motor operation. Those signals from the position transducers are also supplied to a group controller, which employs them in assigning a hall call to one of the cars, more precisely, one of the decks.

Each compartment includes a load-weighing system LW that provides signals LWS to the car controller. These signals manifest the deck load and are sent to the group controller, which also employs them in assigning the hall call to one of the decks. Load weighing systems are known in the art. An appropriate type must simply provide a signal(s) manifesting the deck—not car—loading.

Figure 2:
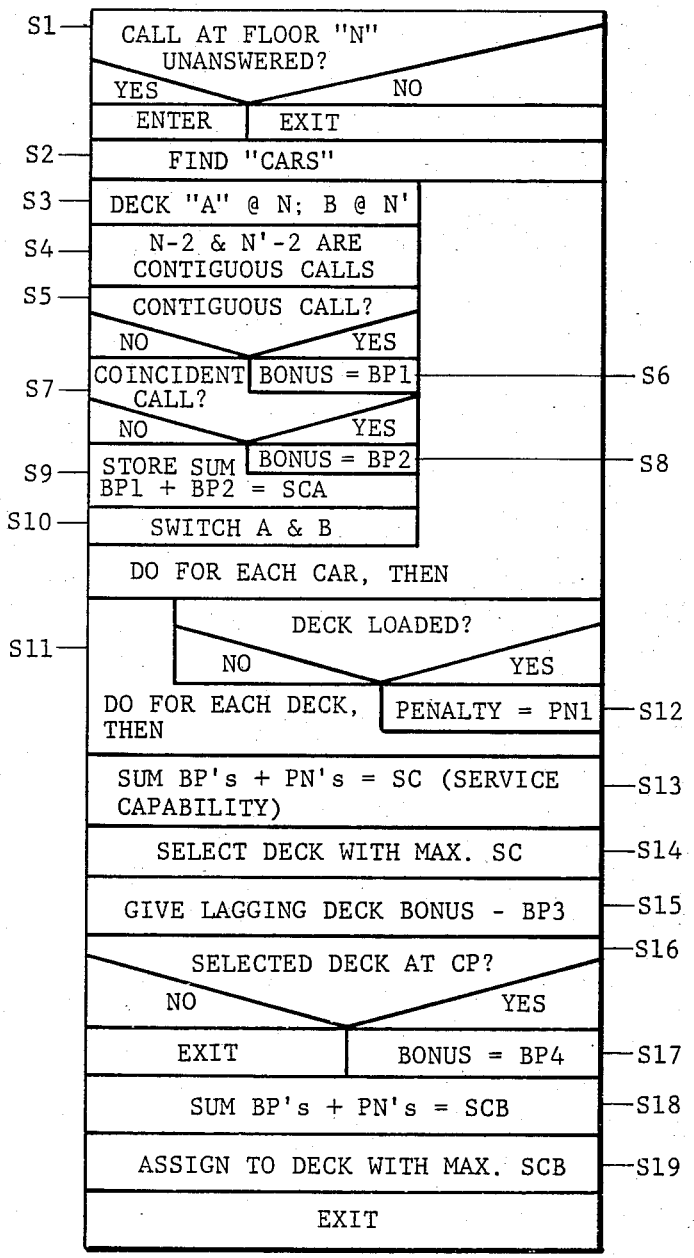
FIG. 2 is a flowchart of a processing system for assigning a hall call according to the present invention.

At any time, the group controller 20 knows each deck's load, car call assignments, hall call assignments (if any), each car's position and operating conditions, and entered, but unassigned, hall calls at the floor. The invention, as said before, focuses on a special assignment scheme, by which a hall call, for instance, an "up" call on floor 27, is ultimately assigned to one of the decks on the cars 1 and 2. This assignment process is implemented by the group controller computer using the process or sequence represented by FIG. 2. It takes place very rapidly, at the CPU processing rate.

The assignment process begins at step S1 when the processor determines that there is a registered hall call at floor "N", e.g., an "up" call at floor 27, which is unanswered. A positive answer to the test at S1 justifies entry into the assignment routine which starts at S2. In step S2, the group controller determines the "CARS", those cars available for the call because they are basically in service, and in so, are moving towards the floor in the correct direction or are parked. Starting at step S3, an examination is made of each of the CARS. First, for one deck "A", floor N (the hall call) is made the primary floor; then N' is established for the other deck "B". N' is the floor adjacent the secondary deck when the primary deck is at N. In step S4, the contiguous car call zone is established for the car. It is N+2 and N'±2; that is, two (2) stops away from the floors N and N'. In step S5, a test is made to determine if there are contiguous calls in either deck A, B to their respective contiguous floors. A bonus, BP1, is assigned at S6 to the primary deck, if either deck has a contiguous call. In step S7, a test is made for coincident calls. This is a car call in either deck to either N, for deck A, or N', for deck B, or an assigned hall call at N' for deck B. A bonus, BP2, for the primary deck is assigned at S8 if a coincident call is assigned either deck. Then, at S9, the bonus points are summed and stored as SCA; this is the service capability of the primary deck. Next, at S10, A and B are reversed; the other deck (deck B) becomes the primary deck. The process is repeated for each of the CARS. Once this is done, the sequence moves from S2 to S11.

At step S11, a test is made as to whether a deck is fully loaded, and is manifested by the LWS signal. At S12, a penalty PN1 is assigned if the deck is fully loaded. This is done for each deck of each of the CARS, and then step S13 is started.

The bonus and penalty points (BP's and PN's) are summed at S15, yielding the service capability SC of each deck. At step S14, the deck with the maximum SC (best service capability) is selected as the likely candidate for the call assignment. Then, at S15, the lagging deck on that car is given a bonus point BP3. If the selected deck is at the committable position CP, (step S16), the bonus BP4 is given to it at S17, and then all bonus and penalty points of each deck are summed in step S18, yielding the "overall" deck service capability SCB. If it is not at the CP, the sequence is exited and then reentered on the affirmative answer to the test at S1. In step S19 the deck with the highest SCB is given the assignment. If the service capability of each deck is otherwise equal, the bonus given to the lagging deck will give it a higher SCB and give it the assignment, favoring a two floor run.

The "deck" selection process, therefore, may be generalized, for understanding, as a process by which each deck of all the available cars is tentatively made the primary deck (the deck to answer the call), from which the deck's overall service capability to answer the call relative to all other decks is determined. In one case, the run is one floor less than in the other case, but the computed run time for both decks is equalized by the process, so as not to favor the leading deck. Then a selection is made between the two decks in a way that favors the lagging deck. The final assignment is made when the committable position of the selected deck of the car is at the hall call floor.

The invention may be implemented in other ways, in addition to any mentioned, and one skilled in the art may make modifications to the described embodiment without departing from the true scope and spirit of the invention.

We claim:

1. An elevator comprising a plurality of double-deck cars servicing a plurality of landings in a building; drive means associated with each car; hall call means and car call means in each deck for registering call; group processing means for controlling operation of the drive means; car position means for indicating to the group processing means the position of each car; and means providing to the group processing means a signal indicating the load in each deck; characterized in that said group processing means comprises:

signal processing means for providing a first signal that manifests the summation of various response factors for each car if each of the decks were assigned a hall call made on the hall call means, each factor representing a deck's ability to service the hall call under a condition based upon the current operating condition of the car to which the deck is attached; for providing a second signal assigning an additional response factor to the lagging deck of the car with the most favorable summation of response factors; for providing a third signal which manifests the sum of various response factors for each deck on said car based on the current operating condition of the decks; for providing a fourth signal for selecting for the call assignment the deck on said car with the most favorable summation of response factors.

2. An elevator according to claim 1, further characterized in that:

said group processing means comprises signal processing means for providing a fifth signal assigning a penalty factor to a deck that is fully loaded to decrease the favorability of the deck to answer the hall call based on the summation of response factors.

3. An elevator according to claim 1, further characterized in that:

said group processing means comprises signal processing means for providing a sixth signal assigning a bonus factor to the deck furthest from the call to improve the favorability of the deck to answer the hall call based on the summation of response factors.

4. An elevator according to claim 1, further characterized in that said group processing means comprises signal processing means for providing a seventh signal assigning a bonus factor when the selected deck is at the committable position for the call to improve the favorability of the deck to answer the hall call based on the summation of response factors.

* * * * *